US010557652B2

(12) United States Patent
Sato et al.

(10) Patent No.: US 10,557,652 B2
(45) Date of Patent: Feb. 11, 2020

(54) HEAT EXCHANGER AND AIR CONDITIONER

(71) Applicant: HITACHI-JOHNSON CONTROLS AIR CONDITIONING, INC., Tokyo (JP)

(72) Inventors: Daiwa Sato, Tokyo (JP); Shigeyuki Sasaki, Tokyo (JP); Ryoichi Takafuji, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 16/270,623

(22) Filed: Feb. 8, 2019

(65) Prior Publication Data

US 2019/0285321 A1 Sep. 19, 2019

Related U.S. Application Data

(63) Continuation of application No. PCT/JP2018/009761, filed on Mar. 13, 2018.

(51) Int. Cl.
*F25B 39/02* (2006.01)
*F28F 1/12* (2006.01)
(Continued)

(52) U.S. Cl.
CPC ..... *F25B 39/028* (2013.01); *F25B 13/00* (2013.01); *F28F 1/04* (2013.01); *F28F 1/12* (2013.01)

(58) Field of Classification Search
CPC ..... F28F 1/12; F28F 1/30; F28F 1/32; F28F 1/325; F28F 13/182; F28F 17/005;
(Continued)

(56) References Cited

U.S. PATENT DOCUMENTS 1,775,041 A * 9/1930 Karmazin ..... F28F 1/325 126/99 D
6,349,761 B1 * 2/2002 Liu ..... F28F 1/32 165/150
(Continued)

FOREIGN PATENT DOCUMENTS

JP 11-108576 A 4/1999
JP 2000-171187 A 6/2000
(Continued)

OTHER PUBLICATIONS

International Search Report and Written Opinion of PCT/JP2018/009761 dated May 29, 2018.

*Primary Examiner* — Jianying C Atkisson
*Assistant Examiner* — Jose O Class-Quinones
(74) *Attorney, Agent, or Firm* — Mattingly & Malur, PC

(57) ABSTRACT

A heat exchanger is provided which has: multiple flat heat transfer pipes configured such that refrigerant for heat exchange with air flowing inside; and a fin having a heat exchange surface between adjacent ones of the heat transfer pipes, wherein the multiple heat transfer pipes are arranged such that flat portions of the heat transfer pipes face each other, the fin has one end and other end in an air flow direction, and a first rib formed vertically above the flat portion, and the first rib has an extension portion extending along the flat portion, and an enlarged portion configured such that a distance to the flat portion gradually increases from the extension portion in a direction of one end side.

19 Claims, 10 Drawing Sheets

(51) Int. Cl.
*F28F 1/04* (2006.01)
*F25B 13/00* (2006.01)

(58) Field of Classification Search
CPC ..... F28F 2215/08; F28F 2215/10; F28F 2245/02; F24F 13/222; F25D 21/14
See application file for complete search history.

(56) References Cited

U.S. PATENT DOCUMENTS

| | | | | |
|---|---|---|---|---|
| 2004/0177949 | A1* | 9/2004 | Shimoya | F28F 1/022 165/152 |
| 2006/0289152 | A1* | 12/2006 | Leuschner | F28D 9/0062 165/152 |
| 2010/0089557 | A1* | 4/2010 | Kim | F28F 1/32 165/151 |
| 2011/0030932 | A1* | 2/2011 | Tucker | B21D 53/08 165/151 |
| 2014/0366568 | A1* | 12/2014 | Kim | F24F 13/22 62/272 |
| 2015/0068244 | A1* | 3/2015 | Lee | F28F 17/005 62/498 |
| 2015/0260436 | A1* | 9/2015 | Kim | B23P 15/26 165/133 |
| 2018/0120039 | A1 | 5/2018 | Nakamura et al. | |

FOREIGN PATENT DOCUMENTS

| | | | |
|---|---|---|---|
| JP | 2013-200119 | A | 10/2013 |
| JP | 2016-102593 | A | 6/2016 |
| WO | 2016/194043 | A1 | 12/2016 |
| WO | 2018/003123 | A1 | 1/2018 |

* cited by examiner

HEAT EXCHANGER AND AIR CONDITIONER

CROSS-REFERENCE TO RELATED APPLICATION

This application is a continuation application of PCT/JP2018/009761, filed on Mar. 13, 2018, the entire contents of which are hereby incorporated by reference.

BACKGROUND

1. Technical Field

The present disclosure relates to a heat exchanger and an air conditioner.

2. Description of the Related Art

In WO 2016/194043 A, a heat exchanger is described, the heat exchanger including a plate-shaped fin having a first region where multiple cutout portions are formed at intervals in a longitudinal direction as a gravity direction and a second region where the multiple cutout portions are not formed in the longitudinal direction and flat pipes attached to the multiple cutout portions and crossing the fin. The fin is provided with protruding portions (hereinafter also referred to as "ribs") protruding from a flat surface portion of the fin. Each first end portion of the protruding portions is positioned in the first region. Each second end portion of the protruding portions is positioned in the second region, and is positioned below the first end portion.

The protruding portion (the "rib") is a reinforcement rib for preventing bending upon manufacturing of the fin by pressing.

A parallel flow heat exchanger is configured such that flat heat transfer pipes (hereinafter referred to as "flat pipes") penetrate many fins stacked in parallel with each other. Performance of the heat exchanger is determined by, e.g., ventilation resistance when air passes through the heat exchanger or the efficiency of heat exchange between refrigerant flowing in the heat transfer pipe and air. In the case of comparison of a projected area as viewed in an air flow direction, the flat pipe has a smaller projected area than that of a circular pipe, and therefore, the ventilation resistance can be reduced. Thus, the flat pipe is sometimes employed for the purpose of reducing the ventilation resistance of the heat exchanger.

A configuration of a heat exchanger of a typical air conditioner will be described. The heat exchanger of the air conditioner mainly includes an evaporator configured to decrease a surrounding air temperature, and a condenser configured to increase the surrounding air temperature. When the surface temperatures of a fin and a heat transfer pipe of the heat exchanger used as the evaporator reach equal to or lower than a dew-point temperature of air, dew condensation occurs. Condensed water due to dew condensation drops along the fin due to gravity force, but is sometimes accumulated due to a narrow spacing between fins or adherence to a protruding object such as a cut-and-raised portion for defining a fin pitch. The condensed water accumulated between the fins closes an air flow path, and therefore, is a cause for a ventilation resistance increase.

When the fin surface temperature reaches below zero, freezing of the accumulated condensed water or frost formation on a fin surface occurs. The frozen condensed water or the frost is a cause for not only increasing ventilation resistance due to closing of the air flow path but also significantly lowering a heat exchange efficiency. Thus, the frost needs to be melted by regular defrosting operation.

However, some or all of functions as the air conditioner are to be stopped, and therefore, performance of the entirety of the air conditioner is lowered. After the defrosting operation, the molten condensed water or frost adheres, as liquid droplets, to the fin surface. Thereafter, when the fin surface temperature reaches below zero again, newly-generated condensed water is frozen due to the liquid droplets or dew condensation caused by the defrosting operation.

Due to the above-described reasons, prompt drainage processing needs to be performed for water adhering to the fin and heat transfer pipe surfaces for maintaining performance of the heat exchanger.

SUMMARY

A heat exchanger according to an embodiment of the present disclosure, includes multiple flat heat transfer pipes configured such that refrigerant for heat exchange with air flowing inside; and a fin having a heat exchange surface between adjacent ones of the heat transfer pipes, wherein the multiple heat transfer pipes are arranged such that flat portions of the heat transfer pipes face each other, the fin has one end and other end in an air flow direction, and a first rib formed vertically above the flat portion, and the first rib has an extension portion extending along the flat portion, and an enlarged portion configured such that a distance to the flat portion gradually increases from the extension portion in a direction of one end side.

DESCRIPTION OF THE EMBODIMENTS

Figure 1:
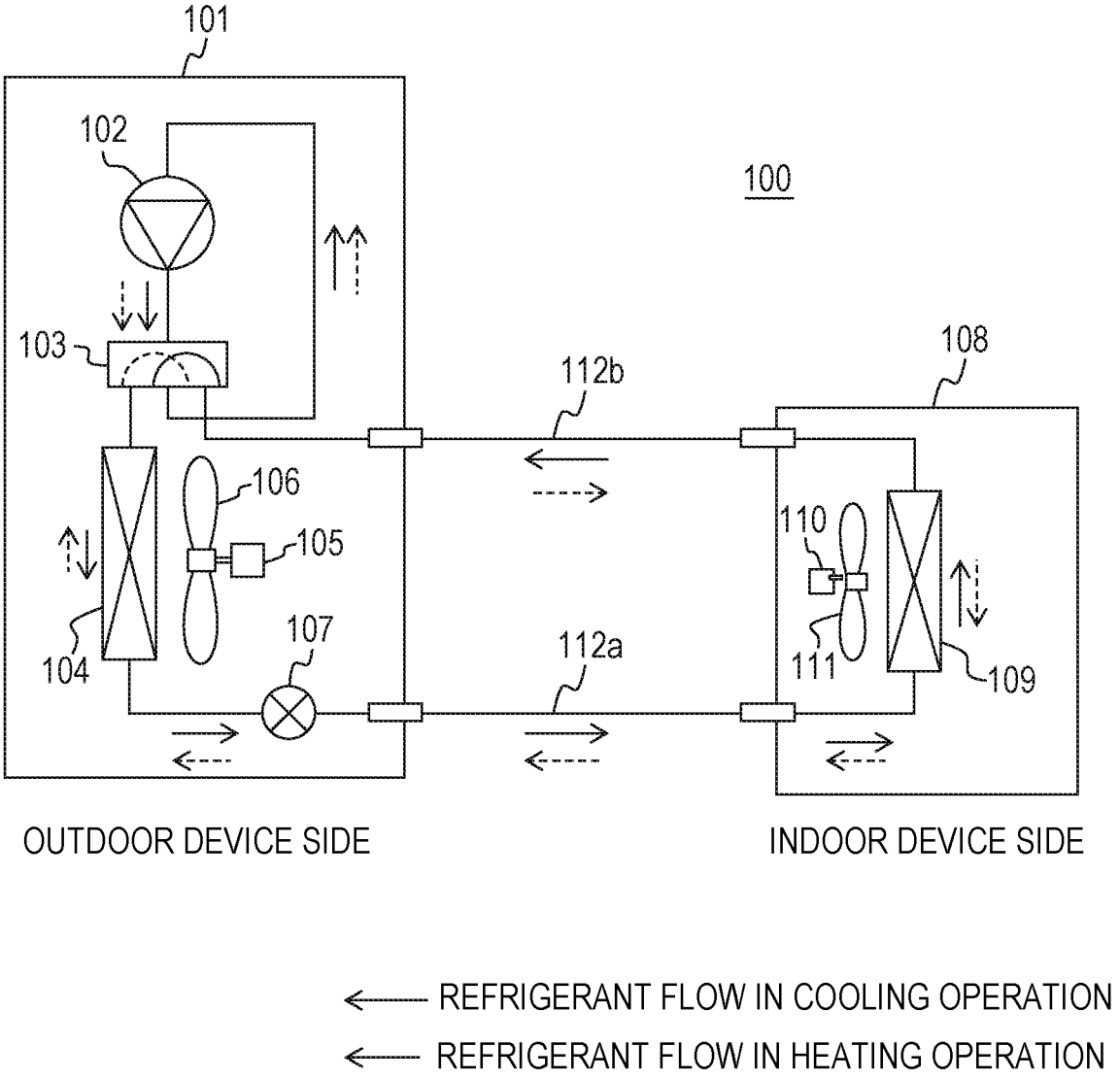
FIG. 1 is a schematic diagram of an air conditioner according to a first embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in the heat exchanger described in WO 2016/194043 A, it is difficult to drain water accumulated on the flat pipe, and there is a problem that an increase in the ventilation resistance due to closing of the flow path between the fins cannot be suppressed.

The air conditioner of the present disclosure has been developed in view of such a situation, and is intended to provide a heat exchanger configured so that water accumulated on a flat pipe can be promptly discharged and ventilation resistance can be reduced and an air conditioner including the heat exchanger.

For solving the above-described problem, the air conditioner of the present embodiment includes multiple flat heat transfer pipes configured such that refrigerant for heat exchange with air flowing inside, and fins each having a heat exchange surface between adjacent ones of the heat transfer pipes. The multiple heat transfer pipes are arranged such that flat portions of the heat transfer pipes face each other. The fin has one end and other end in an air flow direction, and first ribs each formed vertically above the flat portion. The first rib has an extension portion extending along the flat portion, and an enlarged portion configured such that a distance to the flat portion gradually increases from the extension portion in the direction of one end side.

According to the present embodiment, the heat exchanger configured so that water accumulated on the flat pipe can be promptly discharged and ventilation resistance can be reduced and the air conditioner including the heat exchanger are provided.

Hereinafter, the present embodiments will be described in detail with reference to the drawings. Note that the same reference numerals are used to represent common portions in each figure, and overlapping description will be omitted.

(First Embodiment)

FIG. 1 is a configuration diagram of a refrigeration cycle of an air conditioner according to a first embodiment of the present disclosure.

As illustrated in FIG. 1, an air conditioner 100 includes an outdoor device 101 placed on a heat source side outside a room (a non-air-conditioning space), and an indoor device 108 placed on a utilization side inside the room (an air-conditioning space), and the outdoor device 101 and the indoor device 108 are connected to each other via connection pipes 112*a*, 112*b*.

[Air Conditioner 100]

The outdoor device 101 includes a compressor 102, a four-way valve 103, an outdoor heat exchanger 104, an outdoor fan motor 105, an outdoor fan 106, and a throttle device 107. The indoor device 108 includes an indoor heat exchanger 109, an indoor fan motor 110, and an indoor fan 111.

Next, action of each element of the air conditioner 100 will be described with reference to behavior during cooling operation as an example.

In the cooling operation, refrigerant flows in the direction of solid arrows of FIG. 1. First, high-temperature high-pressure gas refrigerant discharged from the compressor 102 flows into the outdoor heat exchanger 104 by way of the four-way valve 103. The refrigerant releases heat to external air in the outdoor heat exchanger 104, and accordingly, is condensed into high-pressure liquid refrigerant. The liquid refrigerant is decompressed by action of the throttle device 107, and accordingly, is brought into low-temperature low-pressure gas-liquid two-phase state. Then, the refrigerant flows into the indoor device 108 via the connection pipe 112*a*. The gas-liquid two-phase refrigerant having entered the indoor device 108 absorbs heat from indoor air in the indoor heat exchanger 109, and accordingly, is evaporated. In this manner, indoor cooling is implemented. The gas refrigerant evaporated in the indoor device 108 returns to the outdoor device 101 via the connection pipe 112*b*, and is re-compressed in the compressor 102 via the four-way valve 103. This is a refrigeration cycle during the cooling operation.

On the other hand, in heating operation, a refrigerant flow path is switched by the four-way valve 103, and refrigerant flows in the direction of dashed arrows of FIG. 1. First, high-temperature high-pressure gas refrigerant discharged from the compressor 102 flows into the indoor device 108 via the four-way valve 103 and the connection pipe 112*b*. The high-temperature gas refrigerant having entered the indoor device 108 releases heat to the indoor air in the indoor heat exchanger 109, and in this manner, indoor heating is implemented. At this point, the gas refrigerant is condensed into high-pressure liquid refrigerant. Thereafter, the high-pressure liquid refrigerant flows into the outdoor device 101 via the connection pipe 112*a*. The high-pressure liquid refrigerant having entered the outdoor device 101 is decompressed by action of the throttle device 107, and is brought into the low-temperature low-pressure gas-liquid two-phase state. Then, the refrigerant flows into the outdoor heat exchanger 104 to absorb heat from outdoor air, and accordingly, is evaporated into gas refrigerant. The gas refrigerant is re-compressed in the compressor 102 after having passed through the four-way valve 103. This is a refrigeration cycle during the heating operation.

As described above, the refrigerant flow direction in the outdoor heat exchanger 104 and the indoor heat exchanger 109 is opposite between the cooling operation and the heating operation. Note that R32 is used as refrigerant, but another type of refrigerant such as R410A may be used.

[Heat Exchanger 10]

Figure 2:
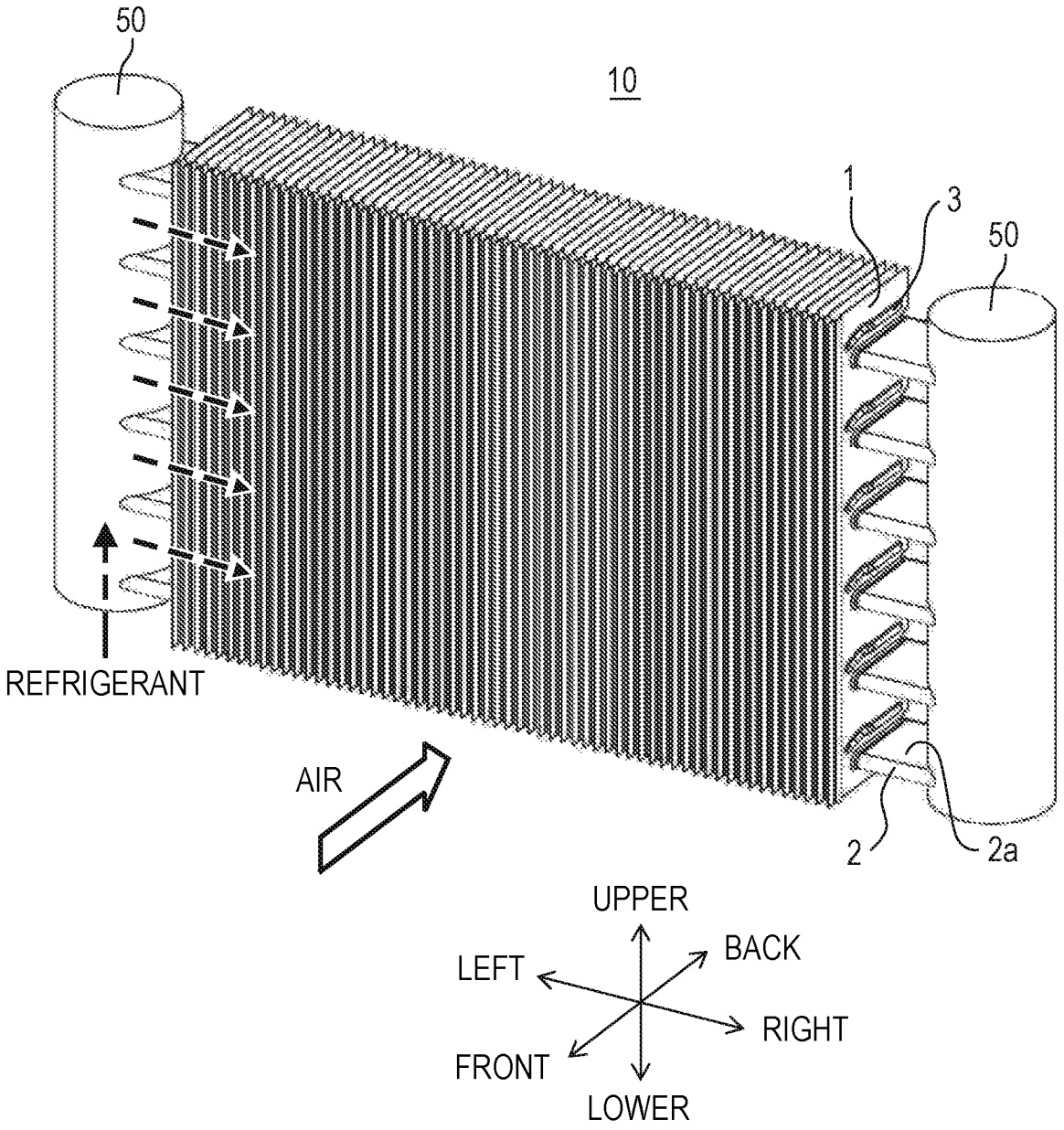
FIG. 2 is a perspective view of an outer appearance of a heat exchanger of the air conditioner according to the first embodiment.

FIG. 2 is a perspective view of an outer appearance of a heat exchanger 10 of the air conditioner 100, and shows, by way of example, a case where a parallel flow heat exchanger is used as an evaporator.

The heat exchanger 10 corresponds to the outdoor heat exchanger 104 or the indoor heat exchanger 109 of the air conditioner 100 as illustrated in FIG. 1.

As illustrated in FIG. 2, the heat exchanger 10 includes two headers 50 including an inflow side header configured to distribute refrigerant on the left side as viewed in the figure and an outflow side header configured to allow refrigerant to join together on the right side as viewed in the figure, multiple flat pipes 2 (heat transfer pipes) connecting between the headers 50 and configured such that refrigerant for heat exchange with air flowing inside, and multiple fins 1 brazed to the flat pipes 2 to expand heat transfer areas thereof.

As illustrated in FIG. 2, the refrigerant flow direction (see dashed arrows) and an air flow direction (see a outlined white arrow) are perpendicular to each other, and heat is, via the fins 1, exchanged between refrigerant flowing in the flat pipes 2 and air flowing between adjacent ones of the flat pipes 2. In this manner, heat exchange is implemented with a favorable efficiency.

Figure 3:
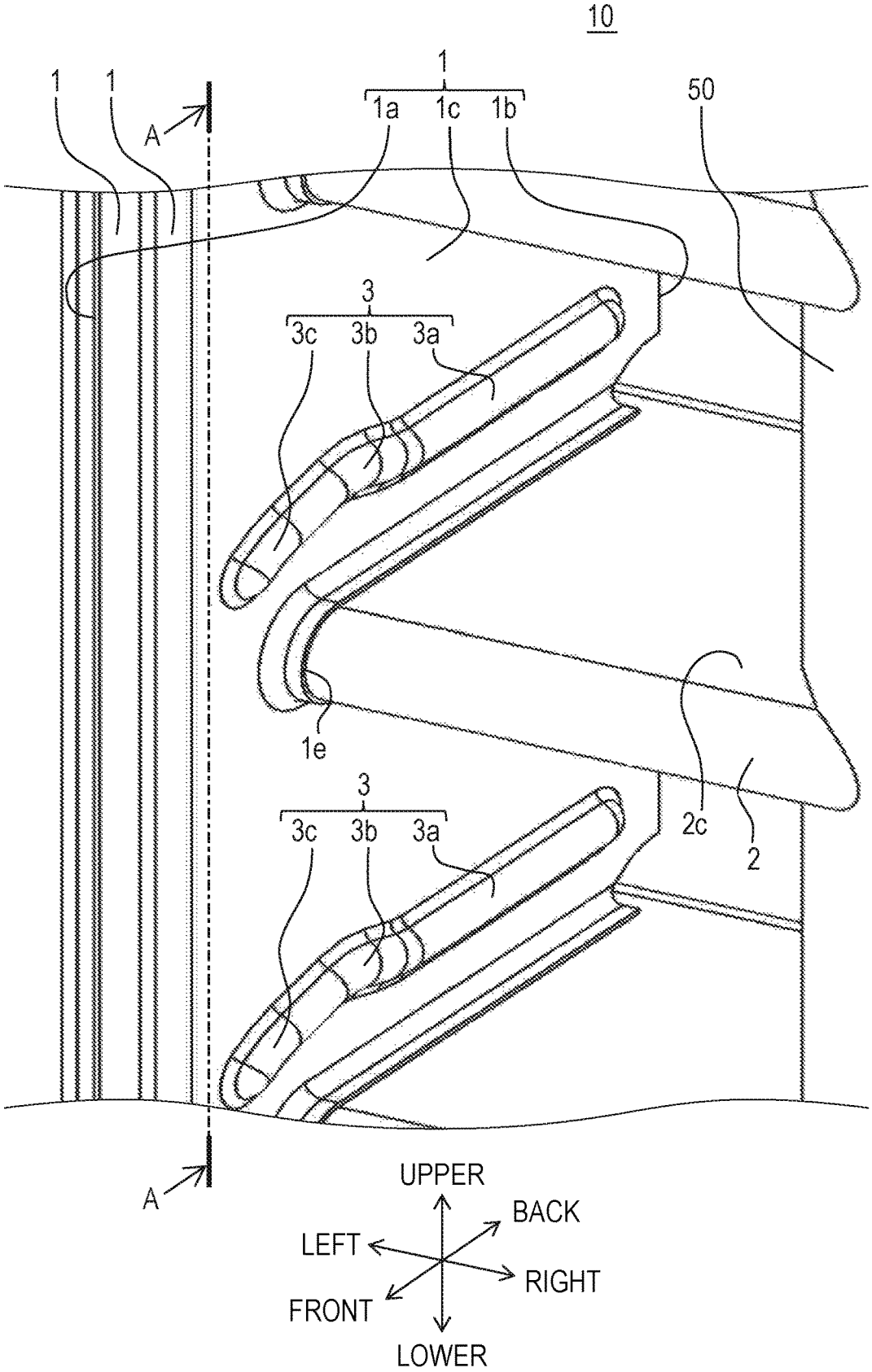
FIG. 3 is a perspective view of a main portion of a fin brazed to flat pipes of the heat exchanger of the air conditioner according to the first embodiment.

FIG. 3 is a perspective view of a main portion of the fin 1 brazed to the flat pipes 2 of the heat exchanger 10.

Figure 4:
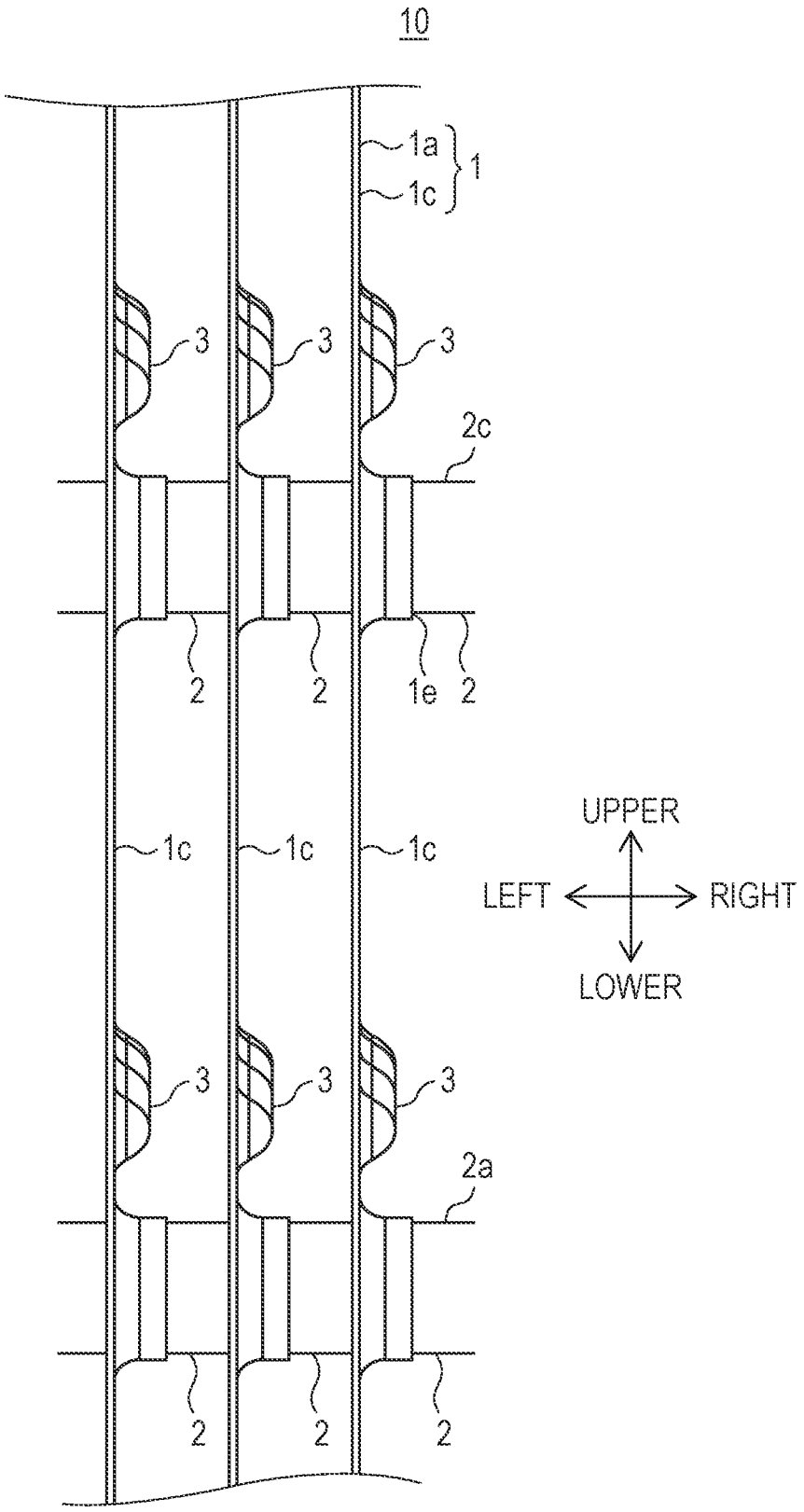
FIG. 4 is a sectional view from an A-A arrow of FIG. 3.
Figure 5:
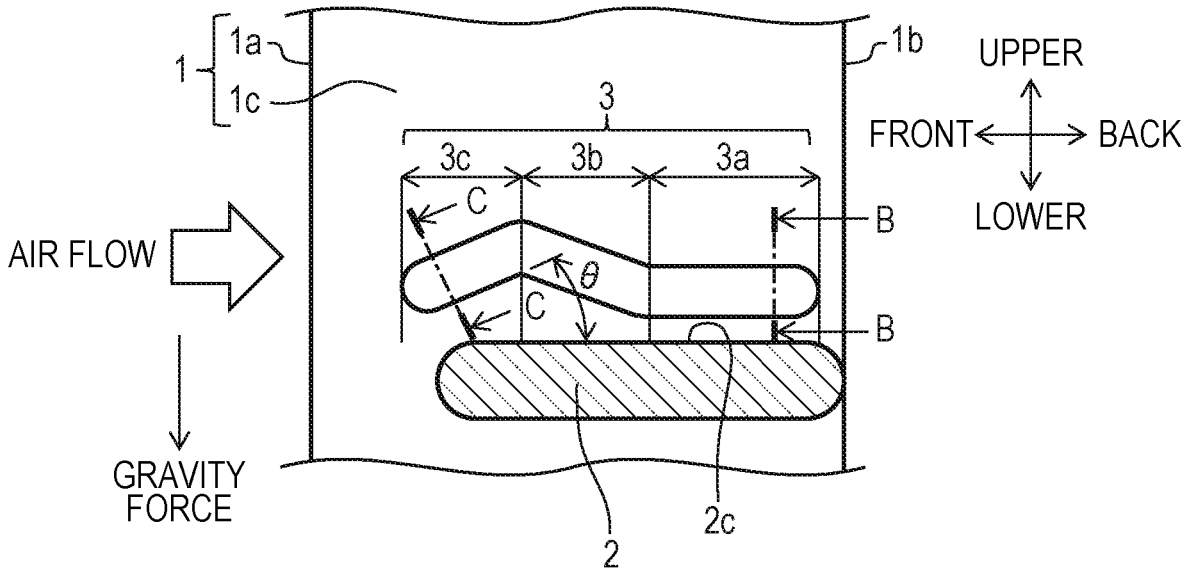
FIG. 5 is a view of a main portion of the fin of the heat exchanger of the air conditioner according to the first embodiment.

FIG. 4 is a sectional view from an A-A arrow of FIG. 3. FIG. 5 is a view of a main portion of the fin 1 of the heat exchanger 10.

As illustrated in FIGS. 2 and 4, the multiple flat pipes 2 are arranged such that flat portions 2*c* of the flat pipes 2 face each other.

As illustrated in FIGS. 3 and 4, the fins 1 are in a flat plate shape, and have insertion holes 1*e* into which the flat pipes 2 are to be inserted. The multiple flat pipes 2 are arranged in an extension direction of the flat pipes 2, and it is configured such that the flat pipes 2 are inserted into the insertion holes 1*e*.

As illustrated in FIGS. 3 to 5, each fin 1 has one end portion (a fin front edge) 1*a* and other end portion 1*b* as edge portions in the air flow direction, a flat surface portion 1*c* of the fin 1 sandwiched by the flat pipes 2, and first ribs 3 each formed vertically above the flat portion 2*c* of the flat pipe 2.

As illustrated in FIG. 3, each first rib 3 has an extension portion 3*a* extending along the flat portion 2*c* of the flat pipe 2, an enlarged portion 3*b* configured such that a distance to the flat portion 2*c* gradually increases from the extension portion 3*a* in the direction of a one-end-portion-1*a* side, and a narrowed portion 3*c* configured such that the distance to the flat portion 2*c* gradually decreases from the enlarged portion 3*b* in the direction of the one-end-portion-1*a* side.

The extension portion 3*a* is configured to extend to above the vicinity of a flat pipe back edge 2*b*.

As illustrated in FIG. 5, the narrowed portion 3*c* gradually narrows at an angle θ with respect to the flat portion 2*c* of the flat pipe 2.

Features and advantageous effects of the extension portion 3*a*, the enlarged portion 3*b*, and the narrowed portion 3*c* will be described later.

Figure 6:
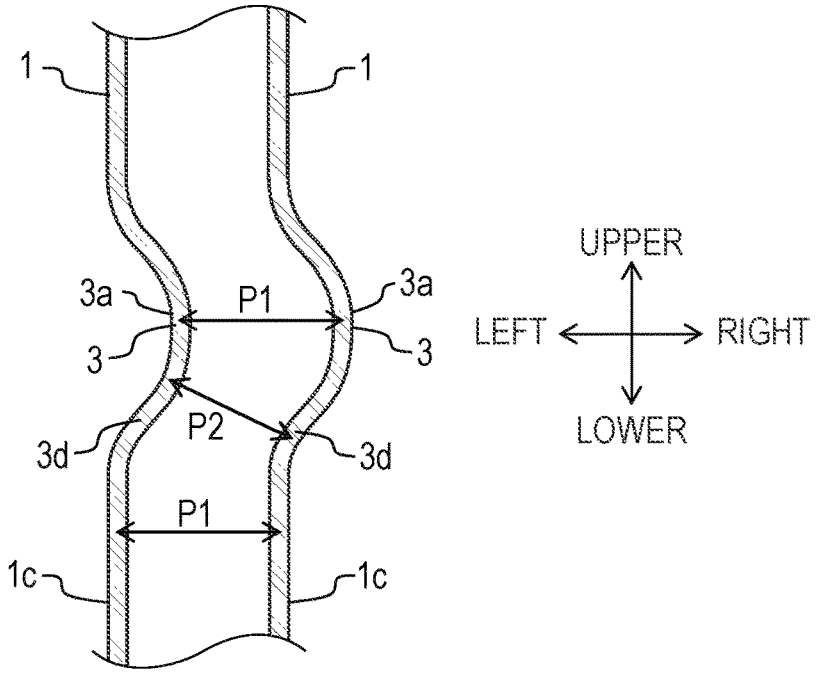
FIG. 6 is a sectional view from a B-B arrow of FIG. 5.

FIG. 6 is a sectional view from a B-B arrow of FIG. 5, and is a sectional view of the fin 1 in a plane perpendicular to the direction of extending the extension portion 3*a* of the first rib 3.

When the fins 1 provided with the first ribs 3 in the same shape are arranged at an interval of a fin pitch P1, a spacing P2 between curved portions 3*d* each extending from the flat surface portion 1*c* of the fin 1 to the top of the first rib 3 is smaller than the fin pitch P1 as illustrated in FIG. 6.

Figure 7:
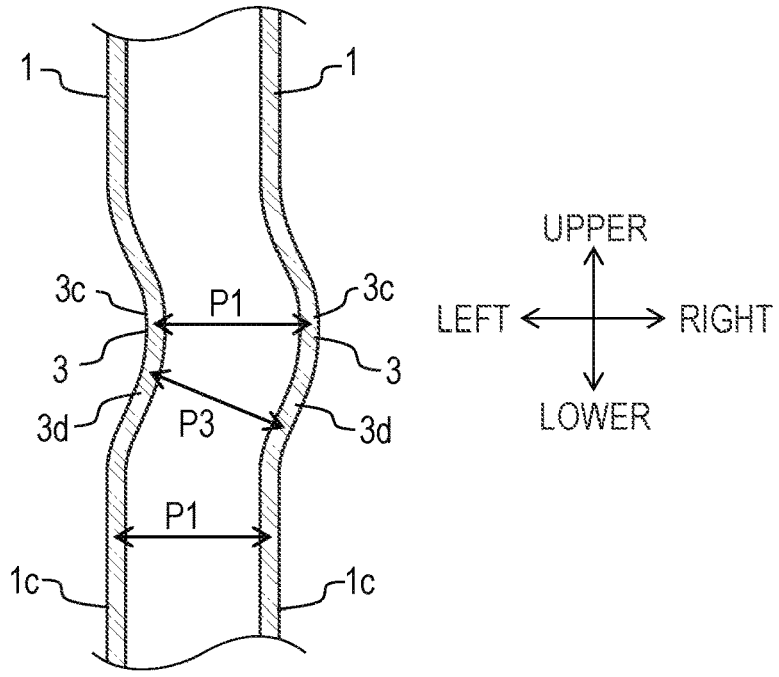
FIG. 7 is a sectional view from a C-C arrow of FIG. 5.

FIG. 7 is a sectional view from a C-C arrow of FIG. 5, and is a sectional view of the fin 1 in a plane perpendicular to the direction of extending the narrowed portion 3*c* of the first rib 3.

The rib height of the narrowed portion 3*c* is set smaller than that of the extension portion 3*a* such that a distance P3 between the rib curved portions 3*d* of the fins 1 closest to each other is greater than a distance P2 at the extension portions 3*a* as illustrated in FIG. 7.

Hereinafter, features and advantageous effects of the heat exchanger 10 of the air conditioner 100 configured as described above will be described.

[First Comparison Example]

First, a first comparative example will be described.

Figure 8:
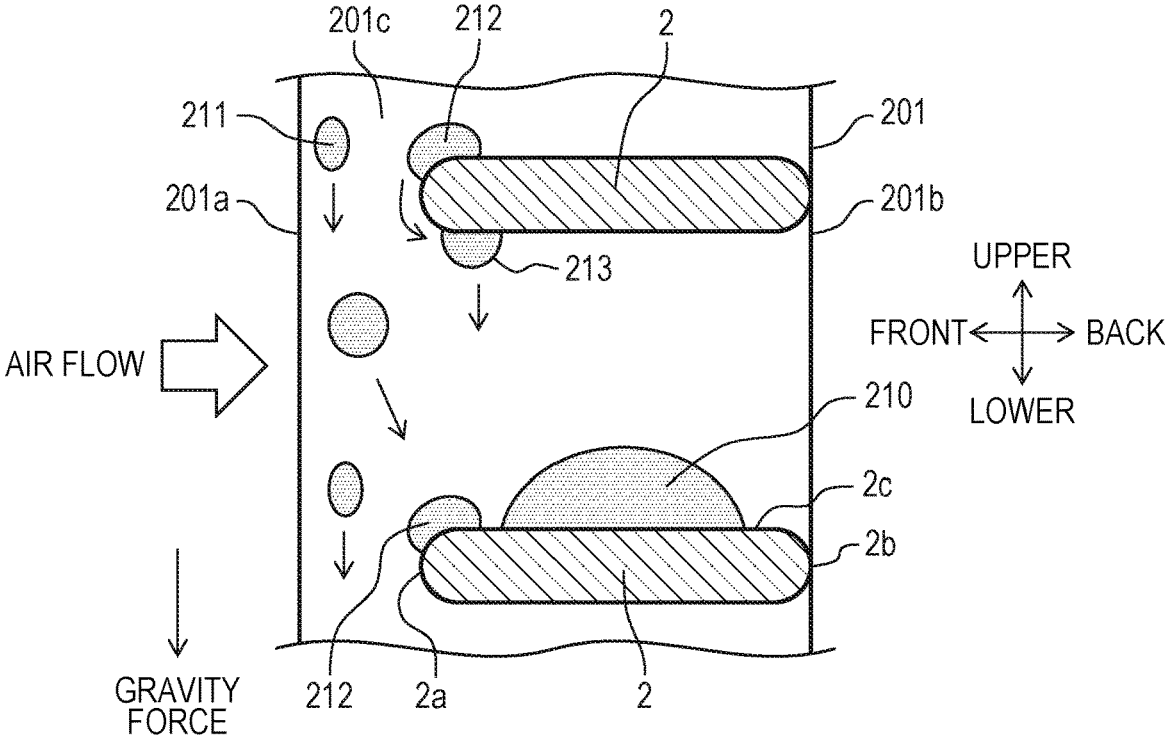
FIG. 8 is a schematic view of behavior of water droplets adhering to a surface of a fin of a typical parallel flow heat exchanger of a first comparative example.

FIG. 8 is a schematic view of behavior of water droplets adhering to a surface of a fin 201 of a typical parallel flow heat exchanger of the first comparative example. When an air inflow side is a front side, dew condensation occurs at a fin front edge 201*a* with high thermal conductivity. Thus, a water droplet 211 adhering to the surface of the fin 201 due to dew condensation drops down along the surface of the fin 201 between a flat pipe front edge 2*a* and the fin front edge 201*a*. However, due to influence of an air flow, the water droplet 211 repeatedly joins other water droplets in the course of dropping, and gradually moves to a back side. Meanwhile, when the water droplet 211 adheres to the flat pipe front edge 2*a*, a water droplet 212 moving down around the flat pipe front edge 2*a* due to influence of surface tension and a water droplet 210 staying accumulated on the flat pipe 2 are generated. A water droplet 213 having moved down drops toward the flat pipe 2, and as a result, the liquid amount of the water droplet 210 accumulated on the flat pipe 2 further increases.

When the surface temperature of the fin 201 reaches below zero, frost is, as in dew condensation, caused at the fin front edge 201*a* with high thermal conductivity. Due to a thermal resistance increase caused by frost formation, water vapor contained in air is less sublimated at the fin front edge 201*a*, and a frost-formed portion gradually expands toward the back side. When defrosting operation is performed in a state in which the frost-formed portion reaches a region sandwiched by the flat pipes 2, the water droplet 213 caused due to melting of frost drops onto the flat pipe 2.

The water droplet 210 accumulated on the flat pipe 2 expand while joining the dropped water droplet 211, but forms a dome shape such that a liquid surface area is minimum due to surface tension. For dropping the water droplet 212, the water droplet 212 needs to move to an end portion (the flat pipe front edge 2*a*) of the flat pipe 2. However, even when the liquid amount of the water droplet 210 is increased, the water droplet 210 is accumulated in the dome shape as described above. For this reason, the water droplet 210 also moves upward, and a great amount of water droplet 210 is necessary for the water droplet 210 to reach the end portion of the flat pipe 2 in a longitudinal direction. As a result, a time until the water droplet 210 is discharged is increased.

When the water droplet 210 is accumulated between the fins 201, an air flow path is closed, and accordingly, ventilation resistance increases. This is a cause for lowering performance of the heat exchanger 10 (see FIG. 2).

[Second Comparative Example]

Next, a second comparative example will be described.

Figure 9:
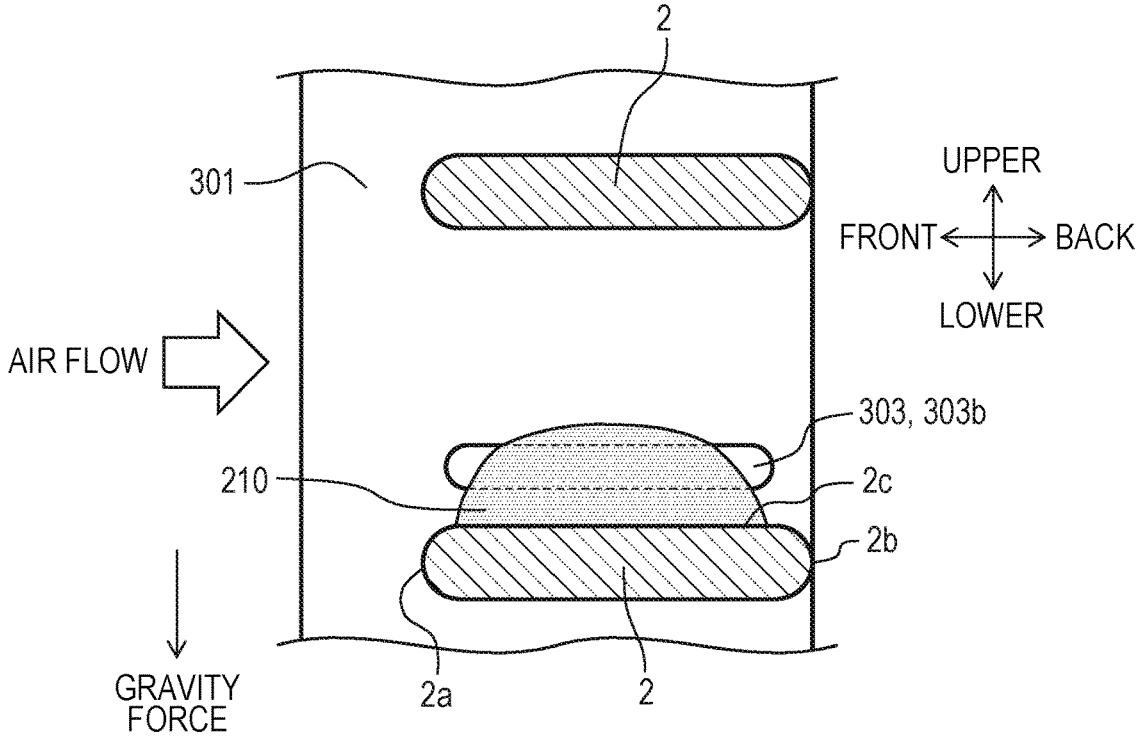
FIG. 9 is a schematic view of behavior of a water droplet adhering to a surface of a fin of a second comparative example.

FIG. 9 is a schematic view of behavior of water droplets adhering to a surface of a fin 301 including a rib 303 according to a second comparison example.

As illustrated in FIG. 9, the rib 303 of the second comparison example does not include the enlarged portion 3*b* as in the first rib 3 illustrated in FIG. 5, and includes only an extension portion 303*b*.

In a state with a small liquid amount, the water droplet 210 is formed along the rib 303, and therefore, moves toward both ends of the flat pipe 2 in the longitudinal direction. When the liquid amount of the water droplet 210 increases, the water droplet 210 is formed in the dome shape extending upward in a gravity direction.

When the liquid amount of the water droplet 210 further increases, an excess portion of the water droplet 210 whose formation in the dome shape is suppressed by the extension portion 303*b* moves toward both ends of the flat pipe 2 in the longitudinal direction. Thus, the liquid amount of the water droplet 210 is not deviated to either one of the end portions of the flat pipe 2 in the longitudinal direction.

Moreover, the enlarged portion 3*b* as in the first rib 3 illustrated in FIG. 5 is not provided. Thus, even when the liquid amount is increased, a distance between the rib 303 and the flat pipe 2 is small, and therefore, the force of holding the water droplet 210 acts due to surface tension. As a result, the water droplet 210 grows upward beyond the rib 303, and a drainage effect by the rib 303 cannot be expected.

[Present Embodiment]

Figure 10:
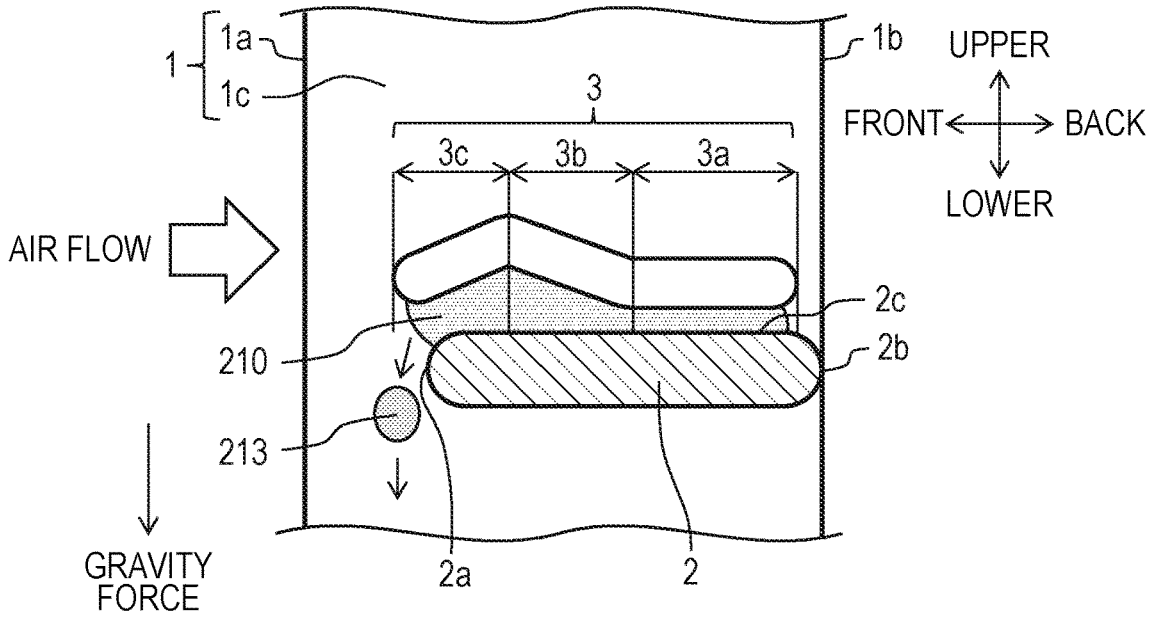
FIG. 10 is a view for describing operation and effect of the heat exchanger of the air conditioner according to the first embodiment.

FIG. 10 is a view for describing the features and advantageous effects of the heat exchanger 10 of the air conditioner 100.

As illustrated in FIG. 10, the first rib 3 of the heat exchanger 10 has the extension portion 3*a* extending to the vicinity of the flat pipe back edge 2*b* along the flat portion 2*c* of the flat pipe 2, the enlarged portion 3*b* configured such that the distance to the flat pipe 2 gradually increases from the extension portion 3*a*, and the narrowed portion 3*c* configured such that a distance between the first rib 3 and the flat pipe 2 gradually decreases from the enlarged portion 3*b* to the flat pipe front edge 2*a*.

<Features and Advantageous Effects of Extension Portion 3*a*>

The extension portion 3*a* is configured to reduce accumulation of the water droplet 210 in the dome shape extending upward in the gravity direction.

The extension portion 3*a* extends to above the vicinity of the flat pipe back edge 2*b*, so that the water droplet 210 accumulated on the back side of the flat pipe 2 can be moved forward and discharged.

<Features and Advantageous Effects of Enlarged Portion 3*b*>

As illustrated in FIG. 10, the excess portion of the water droplet 210 generated due to suppression in upward movement moves to both ends of the flat pipe 2 in the longitudinal direction. The extension portion 3*a* described herein is connected to the enlarged portion 3*b* only on one side, and therefore, the water droplet 210 on the extension portion 3*a* moves toward the enlarged portion 3*b*. That is, the excess portion of the water droplet 210 can be deviated to one end portion of the flat pipe 2 in the longitudinal direction.

Thus, accumulation of the water droplet 210 in the dome shape extending upward in the gravity direction as in the second comparison example of FIG. 9 can be reduced.

When the enlarged portion 3*b* as illustrated in FIG. 10 is not provided, the distance between the first rib 3 and the flat pipe 2 is short, and the force of holding the water droplet 210 due to surface tension acts even when the liquid amount is increased. As a result, the water droplet 210 grows upward beyond the rib as in the second comparison example of FIG. 9, and a drainage effect by the first rib 3 cannot be expected.

As described above, a great amount of water droplet 210 is moved to the flat pipe front edge 2*a* by the enlarged portion 3*b*, so that the effect of inducing drainage of even a small amount of water can be obtained. Thus, an increase in ventilation resistance due to accumulation of the water droplet 210 can be suppressed.

<Features and Advantageous Effects of Narrowed Portion 3*c*>

As illustrated in FIG. 10, the excess portion of the water droplet 210 moves from the extension portion 3*a* to the enlarged portion 3*b* by the enlarged portion 3*b*. In this manner, a great amount of water droplet 210 moves to the flat pipe front edge 2*a*. When the liquid amount of the water droplet 210 further increases, the water droplet 213 drops down along the flat pipe front edge 2*a*.

The narrowed portion 3*c* can further move a liquid surface of the water droplet 210 forward. As illustrated in FIG. 10, a front edge of the narrowed portion 3*c* is positioned forward of the flat pipe front edge 2*a*. Thus, gravity force acts on the liquid surface, and the water droplet 213 is easily dropped. This enhances the drainage effect.

<Features and Advantageous Effects of Angle θ>

As illustrated in FIG. 5, the angle θ between the flat portion 2*c* of the flat pipe 2 and the narrowed portion 3*c* is equal to or less than 45 degrees. When the angle θ is greater than 45 degrees, the following finding has been obtained: the angle θ is coincident with the direction of the liquid surface of the dome-shaped water droplet 210 (see the first comparison example of FIG. 8); this induces formation of the water droplet 210 (see FIG. 8) in the dome shape, and the drainage effect cannot be provided. For inhibiting formation of the water droplet 210 (see FIG. 8) in the dome shape, the angle θ needs to be less than 45 degrees. Preferably, the angle θ between the flat portion 2*c* of the flat pipe 2 and the narrowed portion 3*c* is equal to or less than 30 degrees, so that the drainage effect can be further enhanced.

The angle θ between the flat portion 2*c* of the flat pipe 2 and the narrowed portion 3*c* is equal to or less than 45 degrees as described above, so that drainage can be performed efficiently.

<Features and Advantageous Effects of Curved Portion 3*d*>

As illustrated in FIG. 6, the fin 1 is configured such that the spacing P2 between the curved portions 3*d* each extending from the flat surface portion 1*c* to the top of the first rib 3 is smaller than the fin pitch P1.

The liquid surface of the water droplet is formed such that the surface area is minimum due to surface tension. Thus, when the water droplet contacting both surfaces of adjacent fins 1 comes into contact with the first rib 3, the liquid surface is formed at the curved portions 3*d* of the first ribs 3 such that the surface area of the liquid surface becomes smaller. That is, the shape of the water droplet is formed along the first ribs 3.

As described above, it is configured such that the spacing P2 between the curved portions 3*d* each extending from the flat surface portion 1*c* to the top of the first rib 3 is smaller than the fin pitch P1, and therefore, the water droplet can be formed along the first ribs 3.

As illustrated in FIG. 7, it is configured such that the rib height of the narrowed portion 3*c* is smaller than that of the extension portion 3*a*. Thus, the distance P3 between the curved portions 3*d* of the first ribs 3 of the fins 1 closest to each other is greater than the distance P2 at the extension portions 3*a*. Thus, surface tension is weakened, and therefore, the water droplet 210 (see FIG. 10) having moved to the narrowed portion 3*c* (see FIG. 5) can be more easily dropped.

As described above, it is configured such that the rib height of the narrowed portion 3*c* is smaller than that of the extension portion 3*a*, and therefore, the water droplet having moved to the narrowed portion 3*c* (see FIG. 5) can be more easily dropped.

As described above, the heat exchanger 10 of the present embodiment includes the multiple flat pipes 2 and the fins 1 each having a heat exchange surface between adjacent ones of the multiple flat pipes 2. The multiple flat pipes 2 are arranged such that the flat portions 2*c* of the flat pipes 2 face each other. Each fin 1 has one end and the other end in the air flow direction, and the first ribs 3 each formed vertically above the flat portion 2*c*. Each first rib 3 has the extension portion 3*a* extending to the vicinity of the flat pipe back edge 2*b* along the flat portion 2*c*, and the enlarged portion 3*b* configured such that the distance to the flat portion 2*c* gradually increases from the extension portion 3*a* in the direction of one end side.

With this configuration, the water droplet (e.g., dew condensation water) accumulated on the flat pipe 2 can be efficiently discharged by the first rib 3. The water droplet accumulated on the flat pipe 2 is promptly discharged, and therefore, the heat exchanger 10 configured so that the ventilation resistance can be reduced and a heat exchange efficiency can be improved can be provided.

Specifically, a great amount of water droplet is moved to the flat pipe front edge 2*a* by the enlarged portion 3*b*, so that an increase in ventilation resistance due to accumulation of the water droplet can be suppressed.

In the present embodiment, the first rib 3 includes the narrowed portion 3*c*, and therefore, the liquid surface of the water droplet is further moved forward, so that the water droplet can be easily dropped. Thus, the drainage effect can be enhanced.

In the present embodiment, the extension portion 3*a* extends to above the vicinity of the flat pipe back edge 2*b*. Thus, the water droplet accumulated on the back side of the flat pipe 2 is moved forward, so that the water droplet can be discharged.

In the present embodiment, the angle θ between the flat portion 2*c* of the flat pipe 2 and the narrowed portion 3*c* is equal to or less than 45 degrees, so that formation of the water droplet in the dome shape on the flat portion 2*c* can be inhibited. Thus, the drainage effect can be enhanced.

<Comparison between Present Embodiment and Typical Technique>

A protruding portion of a heat exchanger described in WO 2016/194043 A is a reinforcement rib for preventing bending upon manufacturing of a fin by pressing. For this purpose, the reinforcement rib of the heat exchanger described in WO 2016/194043 A is not configured to extend to above a flat pipe. Moreover, only condensed water dropping from an end portion of the flat pipe is taken into consideration.

An upstream side of the fin 1 in the air flow becomes a region with highest thermal conductivity, and freezing starts from the front side. Thus, water tends to be concentrated on the front side upon melting. However, freezing is actually made to the vicinity of the center of the fin, and therefore, water is accumulated on the flat pipe 2. Moreover, the water accumulated on the flat pipe 2 does not basically move by the water itself. When the amount of water increases and the water reaches the flat pipe end portion, the water drops. However, the water droplet 210 is accumulated in the dome shape on the flat pipe 2 as illustrated in FIG. 8. Thus, the dome-shaped water droplet 210 closes a wind path, and a pressure loss of air increases.

The heat exchanger 10 of the present embodiment includes the first ribs 3, so that accumulation of the water droplet 210 in the dome shape on the flat pipe 2 can be reduced and drainage can be induced by movement of the water droplet 210 to the flat pipe end portion. That is, the extension portion 3*a* reduces accumulation of the water droplet 210 in the dome shape. Moreover, the enlarged portion 3*b* connected to the extension portion 3*a* moves the water droplet 210 to the flat pipe front edge 2*a*. Further, the narrowed portion 3*c* further moves the liquid surface of the water droplet 210 forward, and therefore, the water droplet 213 can be easily dropped.

[First Variation]

Next, a first variation of the present embodiment will be described.

Figure 11:
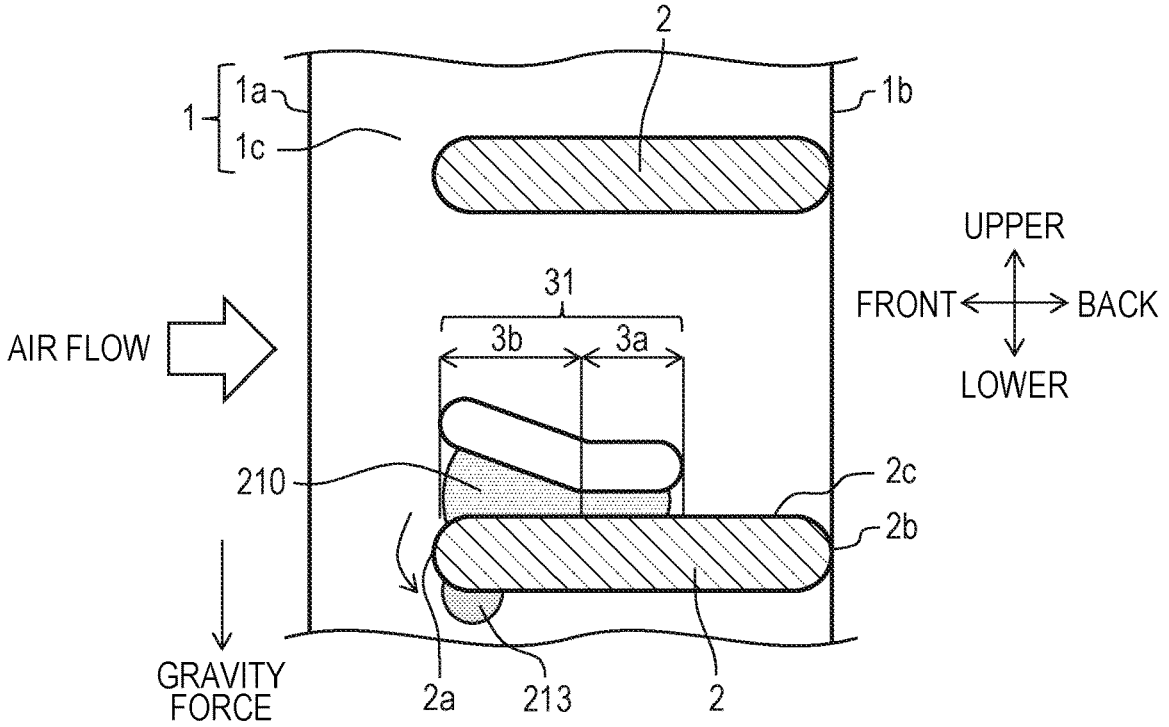
FIG. 11 is a view of a first variation of a first rib of the heat exchanger of the air conditioner according to the first embodiment.

FIG. 11 is a view of a first variation of a first rib 31 of the heat exchanger 10 of the air conditioner 100.

As illustrated in FIG. 11, the first rib 31 of the heat exchanger 10 has the extension portion 3*a* extending along the flat portion 2*c* of the flat pipe 2, and the enlarged portion 3*b* configured such that the distance to the flat pipe 2 gradually increases from the extension portion 3*a*.

The first rib 31 of the first variation employs such a configuration that the narrowed portion 3*c* is removed from the first rib 3 illustrated in FIG. 5, the extension portion 3*a* and the enlarged portion 3*b* are moved forward, and a front edge of the enlarged portion 3*b* is moved to the flat pipe front edge 2*a*.

The first rib 31 is configured to reduce, by the extension portion 3*a*, accumulation of the water droplet 210 in the dome shape extending upward in the gravity direction. The excess portion of the water droplet 210 generated due to suppression in upward movement moves toward the enlarged portion 3*b*. Accordingly, a great amount of water droplet 210 moves to the flat pipe front edge 2*a*.

A great amount of water droplet 210 is moved to the flat pipe front edge 2*a* by the enlarged portion 3*b*, so that an increase in ventilation resistance due to accumulation of the water droplet 210 can be suppressed.

[Second Variation]

Figure 12:
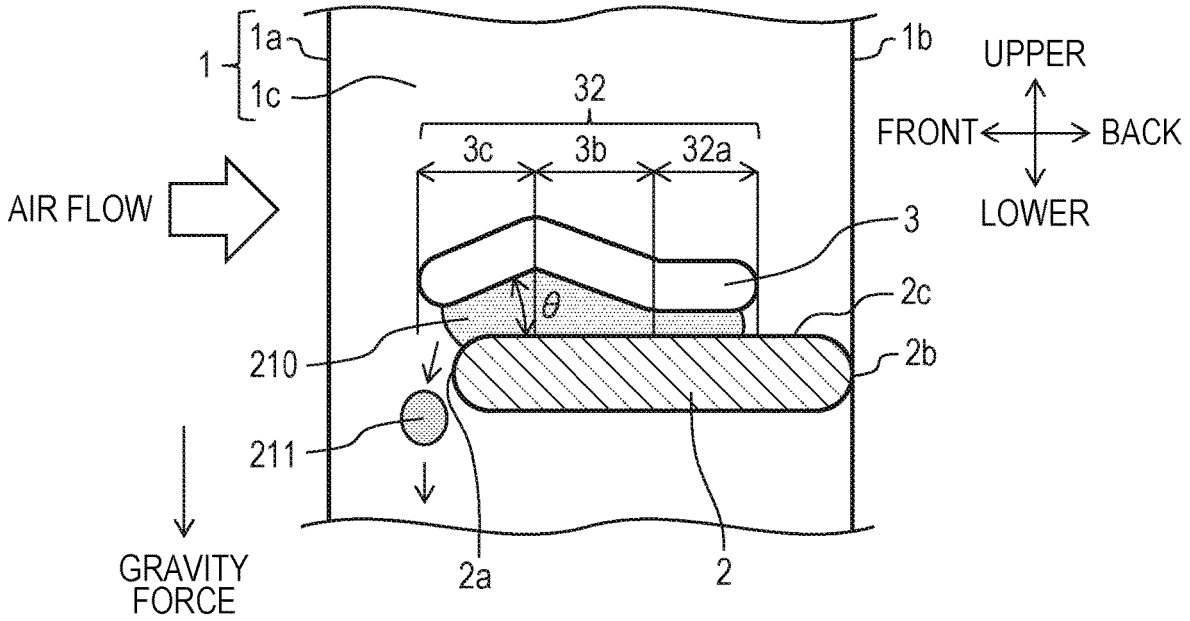
FIG. 12 is a view of a second variation of the first rib of the heat exchanger of the air conditioner according to the first embodiment.

FIG. 12 is a view of a second variation of a first rib 32 of the heat exchanger 10 of the air conditioner 100.

As illustrated in FIG. 12, the first rib 32 of the heat exchanger 10 has an extension portion 32*a* extending along the flat portion 2*c* of the flat pipe 2, the enlarged portion 3*b* configured such that the distance to the flat pipe 2 gradually increases from the extension portion 32*a*, and the narrowed portion 3*c* configured such that a distance between the first rib 32 and the flat pipe 2 gradually decreases from the enlarged portion 3*b* to the flat pipe front edge 2*a*.

The extension portion 32*a* can reduce accumulation of the water droplet 210 in the dome shape extending upward in the gravity direction.

(Second Embodiment)

Figure 13:
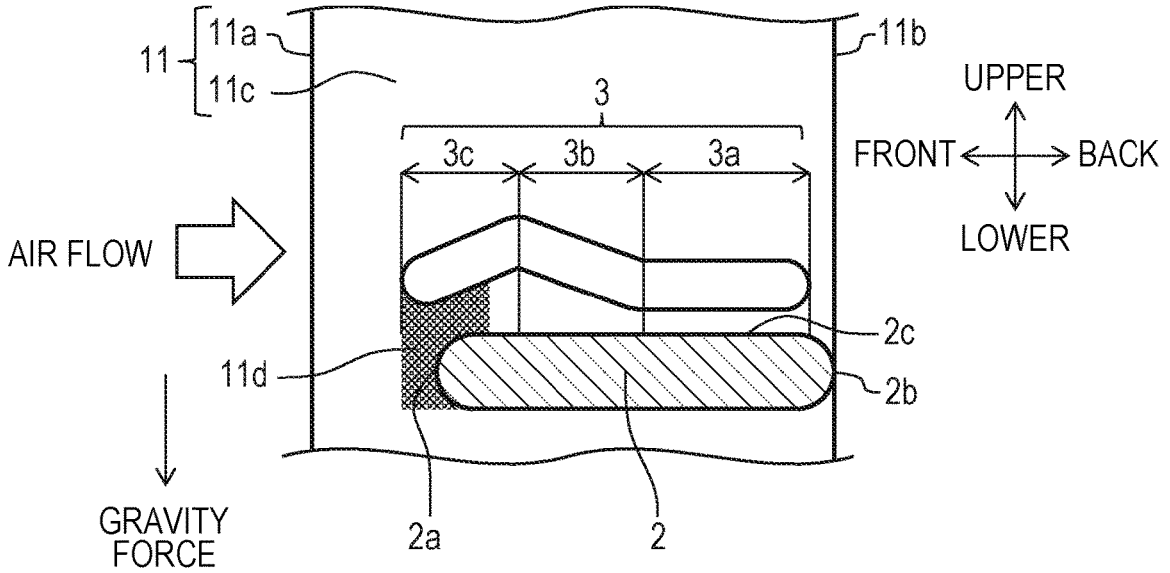
FIG. 13 is a view of a main portion of a fin of a heat exchanger of an air conditioner according to a second embodiment of the present disclosure.

FIG. 13 is a view of a main portion of a fin 11 of a heat exchanger 10 of an air conditioner according to a second embodiment of the present disclosure. The fin 11 illustrated in FIG. 13 can be applied instead of the fin 1 of the heat exchanger 10 of the air conditioner 100 illustrated in FIG. 2.

As illustrated in FIG. 13, the fin 11 has one end portion (a fin front edge) 11*a* and the other end portion 11*b* as edge portions in an air flow direction, a flat surface portion 11*c* of the fin 11 sandwiched by flat pipes 2, a hydrophilic region portion 11*d*, and a first rib 3 formed vertically above a flat portion 2*c* of the flat pipe 2.

As indicated by a shaded portion of FIG. 13, the hydrophilic region portion 11*d* is formed at a lower surface of the narrowed portion 3*c* of the first rib 3 facing a flat pipe front edge 2*a* in the vicinity of the flat pipe front edge 2*a*.

The hydrophilic region portion 11*d* is a region where a surface of the fin 11 exhibits higher hydrophilic properties than those of other surfaces. The hydrophilic region portion 11*d* is formed in such a manner that a hydrophilic coating agent is applied onto the surface of the fin 11.

As described above, in the present embodiment, the fin 11 includes the hydrophilic region portion 11*d*. In the hydrophilic region portion 11*d*, the surface of the fin 11 in the vicinity of the flat pipe front edge 2*a* exhibits higher hydrophilic properties than those of other surfaces. With this configuration, a water droplet moved forward by an enlarged portion 3*b* can be further moved forward. The hydrophilic region portion 11*d* is expanded forward of the flat pipe front edge 2*a*, so that the water droplet can be easily dropped by gravity force. Thus, a drainage effect can be further enhanced.

(Third Embodiment)

Figure 14:
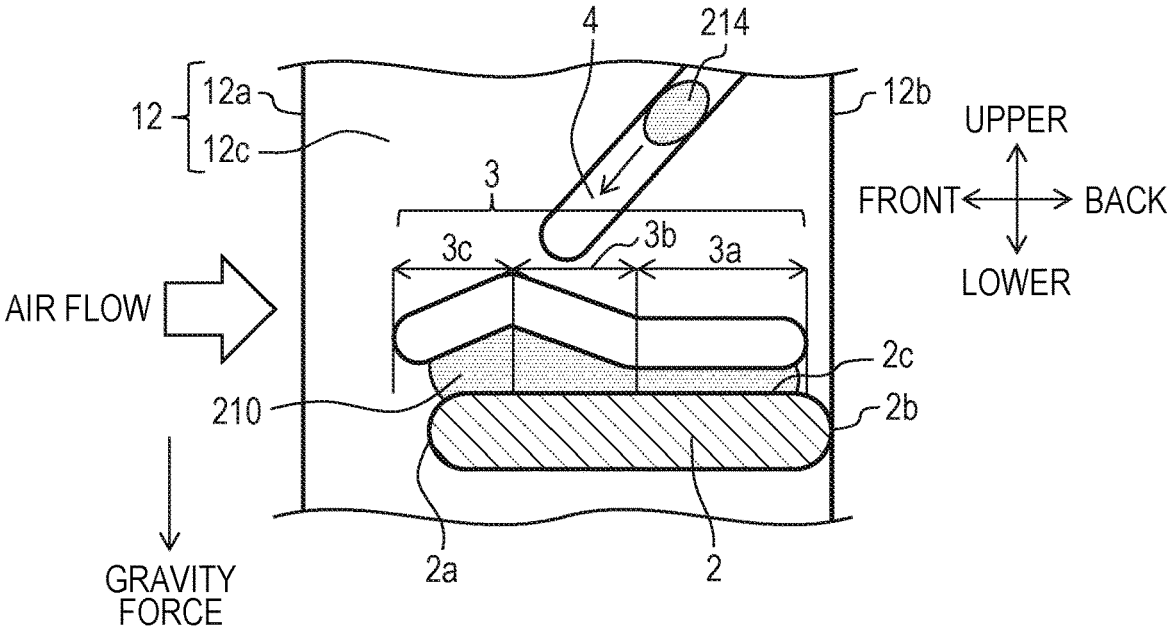
FIG. 14 is a view of a main portion of a fin of a heat exchanger of an air conditioner according to a third embodiment of the present disclosure.

FIG. 14 is a view of a main portion of a fin 12 of a heat exchanger 10 of an air conditioner according to a third embodiment of the present disclosure. The fin 12 illustrated in FIG. 14 can be applied instead of the fin 1 of the heat exchanger 10 of the air conditioner 100 illustrated in FIG. 2.

As illustrated in FIG. 14, the fin 12 has one end portion (a fin front edge) 12*a* and the other end portion 12*b* as edge portions in an air flow direction, a flat surface portion 12*c* of the fin 12 sandwiched by flat pipes 2, a first rib 3 formed vertically above a flat portion 2*c* of the flat pipe 2, and a second rib 4 formed above the first rib 3 to extend from a back side of the fin 12 in the air flow direction toward an enlarged portion 3*b* of the first rib 3.

As described above, in the present embodiment, the fin 12 includes the second rib 4, so that a water droplet 214 dropping from above can be moved to above the enlarged portion 3*b* of the first rib 3. Thus, drainage can be performed with a much higher efficiency.

(Fourth Embodiment)

Figure 15:
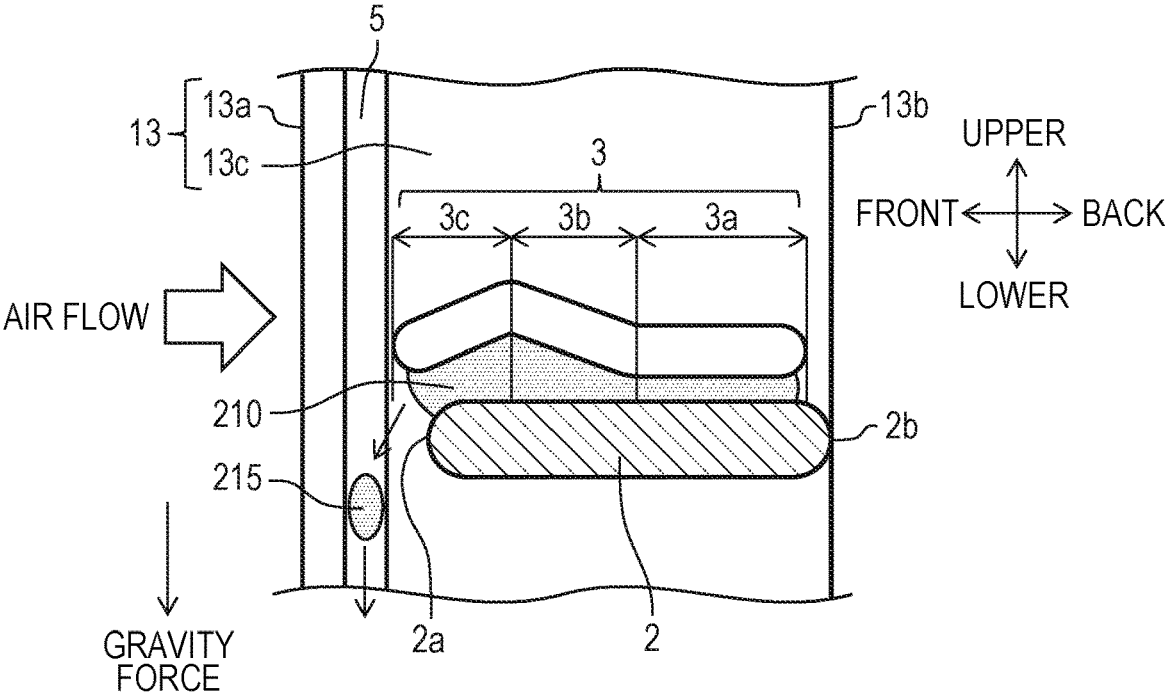
FIG. 15 is a view of a main portion of a fin of a heat exchanger of an air conditioner according to a fourth embodiment of the present disclosure.

FIG. 15 is a view of a main portion of a fin 13 of a heat exchanger 10 of an air conditioner according to a fourth embodiment of the present disclosure. The fin 13 illustrated in FIG. 15 can be applied instead of the fin 1 of the heat exchanger 10 of the air conditioner 100 illustrated in FIG. 2.

As illustrated in FIG. 15, the fin 13 has one end portion (a fin front edge) 13*a* and the other end portion 13*b* as edge portions in an air flow direction, a flat surface portion 13*c* of the fin 13 sandwiched by flat pipes 2, a first rib 3 formed vertically above a flat portion 2*c* of the flat pipe 2, and a third rib 5 extending in a gravity direction at the flat surface portion 13*c* of the fin 13 between the fin front edge 13*a* and a flat pipe front edge 2*a*.

As described above, in the present embodiment, the fin 13 includes the third rib 5, so that re-movement of a water droplet 215 dropped from the flat pipe 2 to above the flat pipe 2 can be reduced. Thus, drainage can be performed with a favorable efficiency.

Note that in FIG. 15, the first rib 3 and the third rib 5 are apart from each other, but a narrowed portion 3*c* of the first rib 3 and the third rib 5 may be connected to each other. In this case, the water droplet 215 formed along the narrowed portion 3*c* directly moves to the third rib 5, and can be more effectively drained.

The present embodiment is not limited to the configuration described in each of the above-described embodiments, and such a configuration can be changed as necessary without departing from the gist of the present embodiment as described in the claims.

The configurations described in each embodiment and the first and second variations can be also applied to a corrugated heat exchanger configured such that a single fin bent in an accordion shape is joined with the fin being sandwiched by flat pipes 2 from above and below. A typical corrugated heat exchanger is configured such that upper and lower fins are separated by the flat pipes 2, and therefore, a fin surface between the fin front edge 1*a* (e.g., see FIG. 3) and the flat pipe front edge 2*a* (e.g., see FIG. 3) is not continuous between the upper and lower fins.

In this corrugated heat exchanger, a water droplet having moved forward drops down along the fin front edge 1*a*. At this point, the water droplet might be drawn backward of the fin front edge 1*a* due to surface tension in the course of dropping, and might drop onto the flat pipe 2. In this case, the water droplet is re-moved forward by the rib 3.

On the other hand, in a case where the fin 1 (e.g., see FIG. 3) is in the flat plate shape having the insertion holes into which the heat transfer pipes 2 are to be inserted, the fin surface between the fin front edge 1*a* and the flat pipe front edge 2*a* is continuous in an upper-to-lower direction, and a water droplet dropped from the flat pipe front edge 2*a* directly drops. Thus, the configurations described in each embodiment and the first and second variations are more effective when the fin 1 is in the flat plate shape.

The above-described embodiments have been described in detail for clearly describing the present embodiment, and are not limited to those including all configurations described above. Moreover, part of a configuration of a certain embodiment may be replaced with configurations of other embodiments, or configurations of other embodiments may be added to a configuration of a certain embodiment. Further, addition/deletion/replacement of other configurations may be made to part of a configuration of each embodiment. For example, a configuration including both of the second rib 4 of the third embodiment and the third rib 5 of the fourth embodiment may be employed.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A heat exchanger comprising:

multiple heat transfer pipes, each having flat portions, configured such that refrigerant for heat exchange with air flows inside; and a fin having a heat exchange surface between adjacent ones of the heat transfer pipes, wherein the multiple heat transfer pipes are arranged such that respective flat portions of the heat transfer pipes face each other, wherein the fin has one end and another end in an air flow direction, and a plurality of first ribs respectively disposed vertically above respective flat portions of the heat transfer pipes, and wherein each first rib has an extension portion extending substantially parallel along the flat portion, and an enlarged portion configured such that a distance to the flat portion gradually increases from the extension portion in a direction toward the one end side.

2. The heat exchanger according to claim 1, wherein the first rib has a narrowed portion configured such that the distance to the flat portion gradually decreases from the enlarged portion in the direction toward the one end side.

3. The heat exchanger according to claim 2, wherein an angle between the narrowed portion and the flat portion is equal to or less than 45 degrees.

4. An air conditioner comprising:

the heat exchanger according to claim 3;

an expansion device; and a compressor, wherein the heat exchanger, the expansion device, and the compressor are connected via a pipe to form a refrigeration cycle.

5. The heat exchanger according to claim 2, wherein the narrowed portion is configured such that a height of the narrow portion from a surface of the fin from which the first rib protrudes is smaller than a height of the extension portion and the enlarged portion from the surface of the fin from which the first rib protrudes.

6. An air conditioner comprising:

the heat exchanger according to claim 5;

an expansion device; and a compressor, wherein the heat exchanger, the expansion device, and the compressor are connected via a pipe to form a refrigeration cycle.

7. An air conditioner comprising:

the heat exchanger according to claim 2;

an expansion device; and a compressor, wherein the heat exchanger, the expansion device, and the compressor are connected via a pipe to form a refrigeration cycle.

8. The heat exchanger according to claim 1, wherein the extension portion extends to above an end portion of each heat transfer pipe in a direction of the another end side.

9. An air conditioner comprising:

the heat exchanger according to claim 8;

an expansion device; and a compressor, wherein the heat exchanger, the expansion device, and the compressor are connected via a pipe to form a refrigeration cycle.

10. The heat exchanger according to claim 1, further comprising:

at a flat surface portion of the fin sandwiched by the heat transfer pipes, a second rib positioned vertically above the extension portion and extending from the another end side of the fin in the air flow direction to the enlarged portion.

11. An air conditioner comprising:

the heat exchanger according to claim 10;

an expansion device; and a compressor, wherein the heat exchanger, the expansion device, and the compressor are connected via a pipe to form a refrigeration cycle.

12. The heat exchanger according to claim 1, further comprising:

at a flat surface portion of the fin between a front edge of the fin in the air flow direction and a front edge of each heat transfer pipe in the air flow direction, a third rib extending in a gravity direction.

13. An air conditioner comprising:

the heat exchanger according to claim 12;

an expansion device; and a compressor, wherein the heat exchanger, the expansion device, and the compressor are connected via a pipe to form a refrigeration cycle.

14. The heat exchanger according to claim 1, further comprising:

at a front edge of each heat transfer pipe in the air flow direction, a hydrophilic region portion configured such that a surface of the fin exhibits a higher hydrophilic property than that of other surfaces.

15. An air conditioner comprising:

the heat exchanger according to claim 14;

an expansion device; and a compressor, wherein the heat exchanger, the expansion device, and the compressor are connected via a pipe to form a refrigeration cycle.

16. The heat exchanger according to claim 1, wherein the fin is in a flat plate shape, and has multiple insertion holes into which a respective one of the heat transfer pipes is to be inserted, the multiple heat transfer pipes are arranged in an extension direction, and the heat exchanger is configured such that each heat transfer pipe is inserted into the insertion hole.

17. An air conditioner comprising:

the heat exchanger according to claim 16;

an expansion device; and a compressor, wherein the heat exchanger, the expansion device, and the compressor are connected via a pipe to form a refrigeration cycle.

18. An air conditioner comprising:

the heat exchanger according to claim 1;

an expansion device; and a compressor, wherein the heat exchanger, the expansion device, and the compressor are connected via a pipe to form a refrigeration cycle.

19. The heat exchanger according to claim 1, wherein each heat transfer pipe extends further toward the another side of the fin than an outer periphery of the respective first ribs.

* * * * *